United States Patent [19]

Diehl et al.

[11] 4,364,978

[45] Dec. 21, 1982

[54] PROCESS FOR HIGH-TEMPERATURE GALVANIZING

[75] Inventors: Erwin Diehl, Mannheim; Wolfgang Müller, Hollfeld; Artur Stroh, Rohrhof, all of Fed. Rep. of Germany

[73] Assignee: Th. Goldschmidt AG, Fed. Rep. of Germany

[21] Appl. No.: 281,221

[22] Filed: Jul. 7, 1981

[30] Foreign Application Priority Data

Aug. 14, 1980 [EP] European Pat. Off. ..... 80104834.9

[51] Int. Cl.[3] ..... C23C 1/02

[52] U.S. Cl. ..... 427/433; 428/659

[58] Field of Search ..... 427/433, 321, 310, 329; 428/659

[56] References Cited

FOREIGN PATENT DOCUMENTS 50-105519 8/1975 Japan .

755889 8/1980 U.S.S.R. ..... 427/433

OTHER PUBLICATIONS

Chem. Abs. 84:125278n, vol. 84, 1976.

*Primary Examiner*—Ralph S. Kendall

*Attorney, Agent, or Firm*—James E. Bryan

[57] ABSTRACT

The invention relates to a process for the high-temperature galvanization of steel parts containing from 0.01 to 0.6 percent by weight of silicon at temperatures of 470° to 550° C., the steel parts being immersed in a zinc melt containing lead in a quantity up to that maximally soluble at the operational temperature employed but containing at least about 2 percent by weight based upon the weight of the zinc melt. In this manner thick and uniform coatings of zinc are achieved.

2 Claims, No Drawings

PROCESS FOR HIGH-TEMPERATURE GALVANIZING

This invention relates to a high-temperature galvanizing process for steel parts containing from 0.01 to 0.6 percent by weight of silicon, by immersion into molten zinc at temperatures of about 470° to 550° C.

In accordance with the solubility diagram, the solubility of lead in molten zinc increases with increasing temperature. For instance at 450° C. the solubility is 1 to 1.5 percent by weight and at 550° C. it rises to above 5 percent by weight.

When iron alloy vessels are used to melt zinc, only low operational temperatures are permissible in these vessels because of the solubility of the iron. Thus, the zinc melt can contain only low amounts of lead, for instance about 0.7 to 1.3 percent by weight of lead, when in steel vessels. If galvanizing is desired at higher temperatures, appropriate ceramic galvanizing vessels are used. While it is possible then to dissolve larger amounts of lead in the zinc melts, in accordance with the higher possible bath temperatures, the expert nevertheless will be deterred. For instance, the text by W. Machu, *Metallische Ueberzuege,* third edition, Akademische Verlagsgesellschaft Geest & Portig KG, Leipzig, 1948, page 191, explicitly recommends that the lead content be as low as possible, as higher proportions reduce the bath fluidity.

It is known moreover to galvanize silicon-killed steel by the method of high-temperature galvanization. However, the zinc coatings so obtained are lacking in uniformity. Now it was surprisingly discovered that when disregarding the teaching to maintain the lead content of the zinc melt as low as possible, steel parts with 0.01 to 0.6 percent by weight of silicon can be galvanized, while forming a uniform zinc coating, by using a high lead content.

Accordingly, in the process of the invention a zinc melt is used containing lead in a quantity up to that maximally soluble at the operational temperature employed, but containing at least 2 percent by weight of lead, based upon the weight of the zinc melt.

The process of the invention also makes it possible to uniformly galvanize silicon-killed steels; this is especially important as regards threaded parts. Therefore it is now feasible to utilize the excellent manufacturing properties of such steels and simultaneously to ensure a high corrosion-resistance because of the uniform zinc coating.

Uniform thicknesses of about 60 to 80 microns are obtained especially when galvanizing small parts (so called cut-rate goods), but also for large-area steel parts, at ordinary extraction rates. However it is also possible by adapting the draw rate to obtain thicker coatings, for instance from 100 to 120 microns. The layer thicknesses are entirely uniform across the entire workpiece. Floating away or peeling of the zinc coatings is not observed.

Especially advantageous results are obtained when the zinc melt additionally contains 0.002 to 0.1 percent by weight of aluminum.

The process of the invention will be further illustrated by reference to the following examples:

EXAMPLE 1

Wedge shims 4 mm thick made of steel and with a silicon content of 0.07 percent by weight are dipped into a zinc metal melt at 545° C. in a ceramic zinc vessel, the zinc melt containing 0.04 percent by weight of aluminum and 5.0 percent by weight of lead. After an immersion time of two minutes and a draw rate of about two m/min, the objects evince a uniform zinc coating of 65 to 70 microns thickness.

EXAMPLE 2

Wedge shims are galvanized similarly to Example 1. The time of immersion in this Example however is 10 minutes. Again a uniform coating 65 to 70 microns thick is obtained.

EXAMPLE 3

Small steel parts with a silicon content of 0.53 percent by weight are galvanized as in Examples 1 or 2. Results corresponding to Examples 1 and 2 are obtained both for an immersion time of two minutes and of 10 minutes.

EXAMPLE 4

Grade 10.9 screws with silicon contents of 0.15 to 0.4 percent by weight are galvanized in a zinc bath containing 2.1 percent by weight of lead and 0.002 percent by weight of aluminum. The galvanization temperature is 545° C. Both for an immersion time of two minutes and of ten minutes, defect-free coatings of 80 to 90 microns are obtained.

EXAMPLE 5

Steel parts with silicon contents of 0.15 to 0.5 percent by weight are galvanized in a zinc bath containing 4 percent by weight of lead and 0.002 percent by weight of aluminum. The galvanization temperature is 535° C. Defect-free coatings of 80 to 90 microns are obtained for immersion times both of two and ten minutes.

It will be obvious to those skilled in the art that many modifications may be made within the scope of the present invention without departing from the spirit thereof, and the invention includes all such modifications.

What we claim is:

1. In the process for high-temperature galvanizing steel parts containing from 0.01 to 0.6 percent by weight of silicon by immersion into molten zinc heated to about 470° to 550° C., the improvement which comprises using a zinc melt containing lead in a quantity up to the maximally soluble amount at the operational temperature employed but at least about 2 percent by weight based upon the weight of the zinc melt.

2. A process according to claim 1 in which the zinc melt additionally contains about 0.002 to 0.1 percent by weight of aluminum based upon the total weight of the melt.

* * * * *